United States Patent [19]

Klundt

[11] 4,122,789

[45] Oct. 31, 1978

[54] SEWING MACHINE HAVING AN OIL FILTER

[75] Inventor: Kurt Klundt, Hirschhorn, Germany

[73] Assignee: Pfaff Industriemaschinen GmbH, Germany

[21] Appl. No.: 858,162

[22] Filed: Dec. 7, 1977

[30] Foreign Application Priority Data

Dec. 24, 1976 [DE] Fed. Rep. of Germany ... 7640656[U]

[51] Int. Cl.[2] ..... D05B 71/00

[52] U.S. Cl. ..... 112/256; 184/6.15

[58] Field of Search ..... 112/235, 256; 184/6.5, 184/6.15, 6.24

[56] References Cited

U.S. PATENT DOCUMENTS

| | | | |
|---|---|---|---|
| 2,430,369 | 11/1947 | Sauer | 112/256 |
| 2,456,591 | 12/1948 | Parry | 112/256 |
| 2,727,480 | 12/1955 | Peterson | 112/256 |
| 3,478,709 | 11/1969 | Fischbein et al. | 112/256 |
| 3,933,107 | 1/1976 | Davies et al. | 112/256 |

*Primary Examiner*—Henry S. Jaudon

*Attorney, Agent, or Firm*—McGlew and Tuttle

[57] ABSTRACT

A sewing machine includes a housing having an oil pan portion defining an oil reservoir with a filter supported on a wall of the sewing machine housing in a position above the reservoir. A pump is employed to direct the lubricating oil upwardly through a pipe connection into the top of the filter and a portion of the oil which is pumped is circulated through a small size tube in a continuous manner such that it is deflected against a viewing glass at the top of the sewing machine and drops down into the operating mechanism contained in the sewing machine housing. In addition, a portion of the oil which is pumped into the filter passes through a removable filter cartridge and into the interior of the filter. Before it is passed to any of the bearing parts of the main shaft, it is directed through a top opening in an upstanding pipe of an insert in the filter and downwardly through the pipe at the interior of the filter after having been filtered by passing through the filter material of the filter from the outside part of the filter housing and is then fed under pressure to the various bearing surfaces. The filter housing also includes a drain opening at the lower end thereof which is arranged so that it is closed by insertion of a filter with an annular sealing cap and its sealing member so that it covers the drain opening when the filter element is in an operative position inserted in the filter housing. When oil is to be drained, the filter element is removed upwardly to uncover the drain opening first so that little, if any, unfiltered oil will be able to move downwardly through the pipe having the inlet for the force feeding of the bearings.

8 Claims, 4 Drawing Figures

SEWING MACHINE HAVING AN OIL FILTER

FIELD AND BACKGROUND OF THE INVENTION

This invention relates in general to sewing machines and, in particular, to a new and useful sewing machine with a forced lubrication system and a filter arranged above the oil pan which comprises a housing and a removable filter insert.

DESCRIPTION OF THE PRIOR ART

In a known sewing machine with a forced lubricating system, a cup-type filter housing closed by a cover is secured on the outside of the machine housing. A tubular filter insert is arranged in the housing and it traverses the housing from the outside toward the center and it can be pulled out upwardly for cleaning purposes or replacement. The inlet opening for the unfiltered oil is located in the bottom of the filter housing, namely, in the zone of the annular chamber between the filter insert and the filter housing. The outlet opening for the filtered oil is located in the center of the bottom of the filter housing and, when the filter insert is inserted, it is sealed from the inlet opening or from the annular chamber. As soon as the filter insert is lifted, however, the filtered and unfiltered oil become mixed, thus permitting dirt particles of the unfiltered oil to get into the center of the filter housing. When inserting the new or the cleaned filter insert into the filter housing, now filled with mixed oil, dirt particles will necessarily get into the interior of the filter insert and then through the outlet opening and via the various feed lines to the bearing points of the drive elements.

SUMMARY OF THE INVENTION

In order to avoid the aforementioned disadvantage, the invention provides a filter insert which is intended for sewing machines with a forced lubrication system which comprises a housing and a removable filter insert, constructed in a manner such that no unfiltered oil gets into the outlet opening of the filter during the changing of the filter insert. The filter housing comprises an oil return bore which is closed when the filter insert is in an operative position and it is free when the filter insert is in a non-operative position.

Upon removal of the filter insert, the oil return bore of the invention is cleared, whereupon, the oil contained in the filter housing flows through the oil return bore into the oil pan. Since by removing the filter insert, the seal between the inlet opening for the unfiltered oil and the outlet opening for the filter oil is broken, the filtered oil mixes with the unfiltered oil. With the filter of the invention, however, this process has no adverse consequences because the entire oil will have flown out of the filter housing in time before the new or cleaned filter insert is inserted.

According to a further proposal of the invention, in a filter provided with an insert extractable upwardly, the outlet opening thereof lies higher than the oil return bore. By this measure, after the lifting of the filter insert, the oil level inside of the filter sinks at a relatively early time below the outlet opening for the filtered oil, whereby, penetration of unfiltered oil into the outlet opening is prevented more reliably.

When using a tubular filter insert traversed from the outside toward the center, an advantageous design is characterized in that the outlet opening of the filter is located in the zone of the upper end of a pipe secured in the bottom of the filter housing with the height of the pipe corresponding essentially to the height of the filter insert, or as high as the construction of the filter insert or of the filter housing will permit.

According to another proposal of the invention, the upper end of the pipe is closed and the outlet opening of the filter is provided in the wall of the pipe. By this measure, an advantage is achieved in that when the filter cover is removed over a pipe open at the top, no dirt particles can fall into the pipe or into the outlet opening of the filter.

Accordingly, it is an object of the invention to provide an improved sewing machine with a forced lubrication system which includes an oil pan and a filter arranged above the oil pan with the filter comprising a housing having a removable filter insert which is insertable in the housing into an operative position in which its lower end covers the end of an oil return bore and is arranged so that when the filter is removed for replacement or cleaning purposes, the oil return bore will be opened to drain the filter housing, preferably, so that no unfiltered oil will pass downwardly through a connecting pipe for the forced feed of lubricating oil to bearing surfaces from the filter housing.

A further object of the invention is to provide a sewing machine having a forced lubrication system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
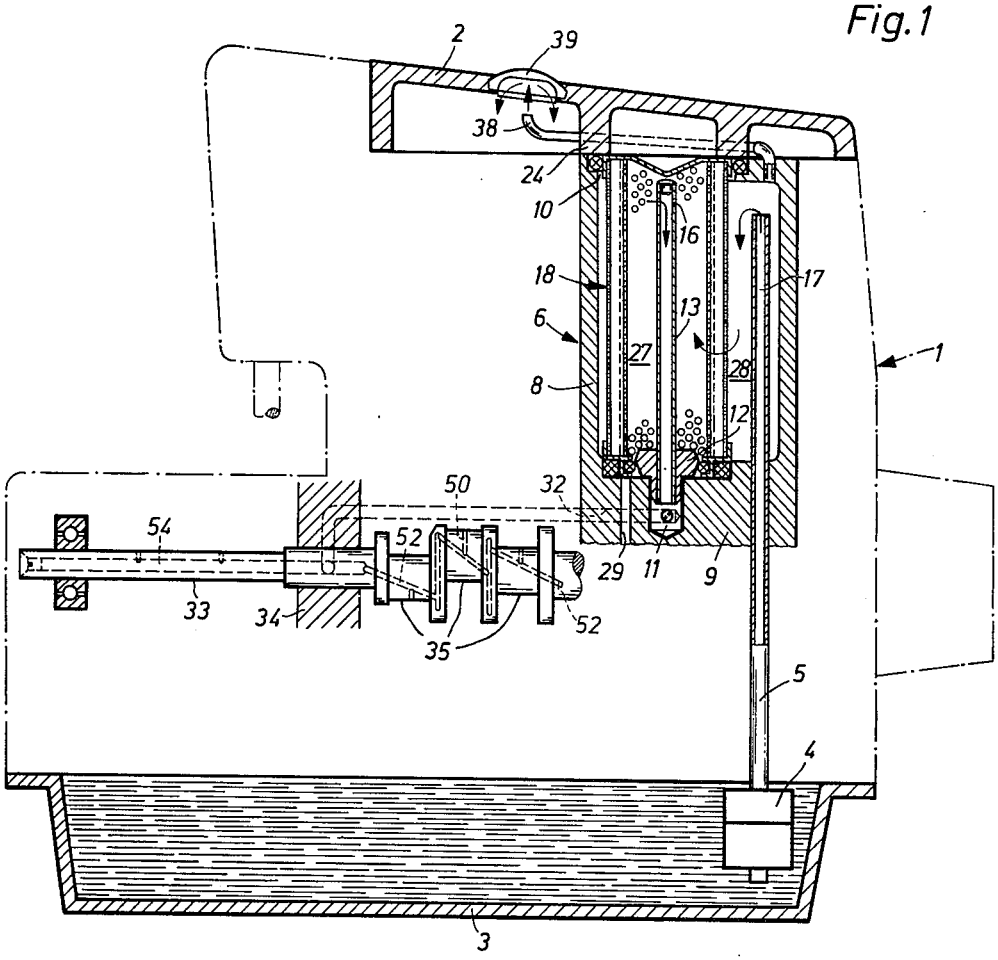
FIG. 1 is a partial sectional view of a sewing machine having a forced lubrication system constructed in accordance with the invention.
Figure 2:
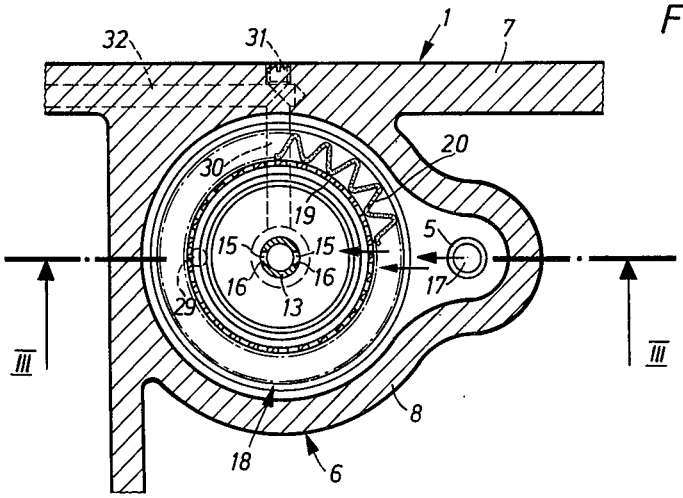
FIG. 2 is a horizontal sectional view of the filter housing shown in FIG. 1 on an enlarged scale and taken on the line II—II of FIG. 4.
Figure 4:
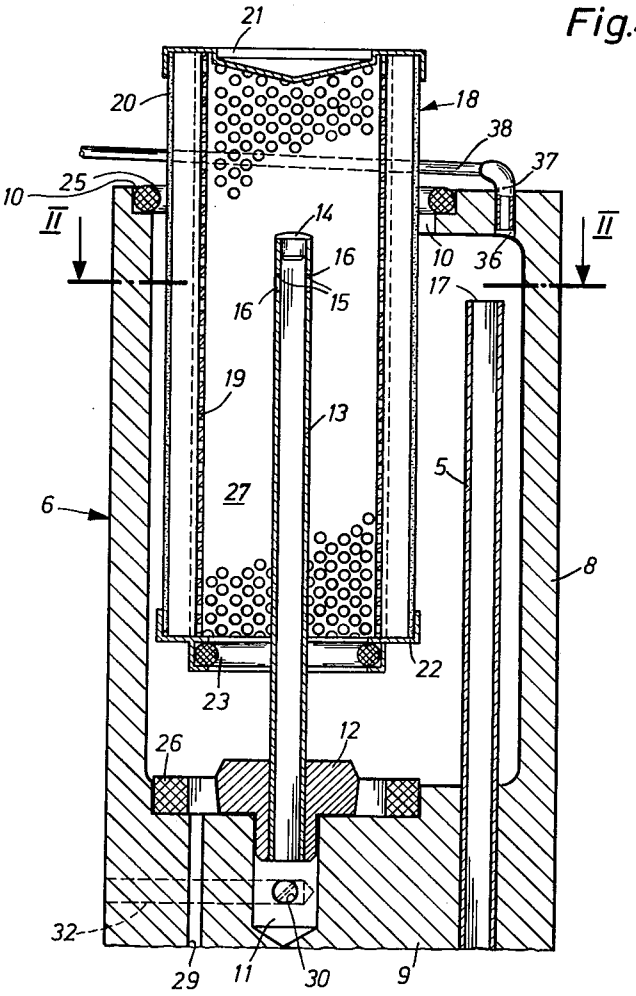
FIG. 4 is a view similar to FIG. 3 showing the filter insert in an inoperative position or lifted upwardly slightly so as to drain the interior of the filter housing.
Figure 3:
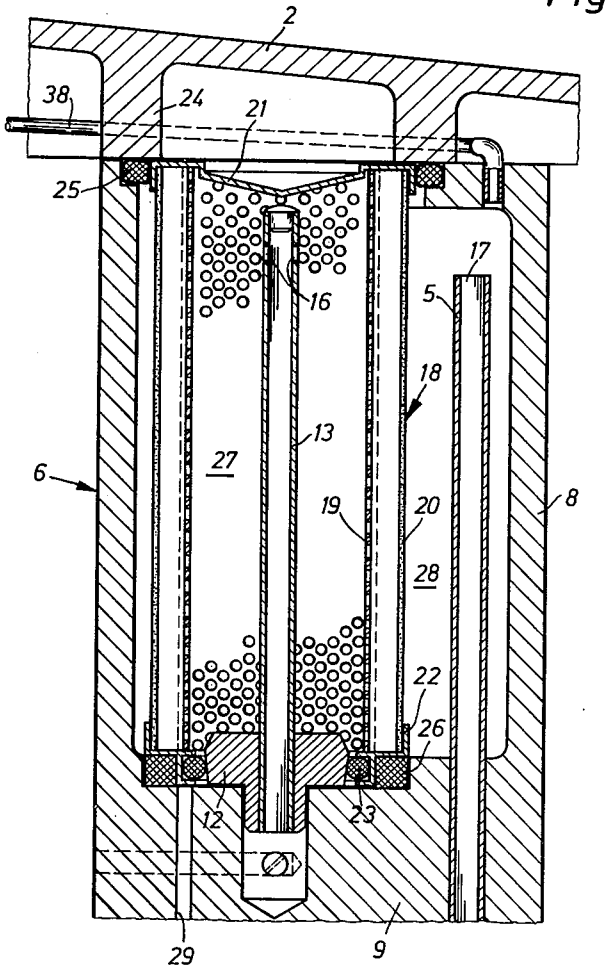
FIG. 3 is an enlarged sectional view of the filter housing taken along the line III—III of FIG. 2.

Referring to the drawings in particular, the invention embodied therein, comprises a sewing machine, generally designated 1, which has a forced lubrication system, which includes a filter, generally designated 6, having a housing 8 arranged above an oil pan 3 defining a reservoir for a lubricating oil.

The overcast sewing machine, shown in FIG. 1, comprises a housing 1, shown in dash-dot lines, a housing cover 2, and an oil pan 3. The sewing machine is further equipped with pump means for circulating lubricating oil from the oil pan 3 to the parts requiring lubrication and it includes a known oil pump 4, which draws unfiltered oil from the oil pan 3, pumping it through a pipe 5 into a filter 6 contained inside of the housing 1.

Filter 6 has a cup-shaped filter housing 8 contiguous to an outer wall 7 of housing 1 and includes a bottom 9 and an opening 10 at the top. A blind bore 11 is provided in the bottom 9, in which an insert piece 12 is secured, which carries oil passage means including a pipe 13 rising vertically into filter housing 8. The upper end of pipe 13 is closed by a plug 14. Below plug 14, two cross-bores 15, 15 are provided in the pipe 13 which extends crosswise to the longitudinal axis thereof. The openings of bores 15, 15 present in the wall of pipe 13 form the outlet aperture 16 of filter 6. Pipe 5, which opens into the filter 6 or the filter housing 8 forms, by its upper open end, the inlet aperture 17 of filter 6.

A tubularly formed filter insert 18 is arranged in housing 8 and it comprises a cylindrically bent, sieve-type or perforated support sheet 19 and a filter-material wall 20 disposed on the outside thereof and includes pleats, i.e., it is folded in zig-zag form. A cover 21 is arranged at the upper end of the filter insert 18 and an annular cap 22 with seal ring 23 is arranged at the lower end thereof. The opening 10 of the filter housing 8 is closed by an annular shoulder 24 of the housing cover 2 and by a seal ring 25.

A seal ring 26 is arranged on the bottom 9 and the filter insert 18 with its cap 22 rests on the ring. This seal ring 26, together with seal ring 23 applying against the insert piece 12, brings about a seal between the interior 27 of the filter insert 18 and an annular chamber 28 between the filter insert 18 and the filter housing 8.

The bottom 9 of the filter housing 8 has a continuous oil return bore 29, whose upper opening lies between the seal ring 26 and the insert piece 12. With the filter insert 18 in an operative position, the oil return bore 29 is closed by the filter insert 18 and the seal rings 23 and 26, so that during this time, no oil present in filter 6 can flow out through the oil return bore 29.

A bore 30 opens into the blind bore 11 located within the bottom 9 with the other end of said bore being closed by a headless screw 31. Bore 30 receives a bore 32 provided in the outer wall 7, with other bores following, which are not designated specifically and which are provided in the walls of housing 1. The last of these interconnected bores finally opens in the bearing surface of a bearing bracket 34 carrying the main shaft 33 of the machine. As seen in FIG. 1, the main shaft 33 is provided with transverse and longitudinal bores 50 and 52 with one transverse bore opening into each of the bearing surfaces of the crank pins 35 driving the machine parts (not shown).

An angular pipe section 37 is arranged in a bore 36 provided at the upper end of the filter housing 8, which carries a tubule 38 extending behind the shoulder 24. Tubule 38 ends below a viewing glass 39 secured in the housing cover 2.

With the sewing machine switched on, the oil pump 4 continuously draws unfiltered oil from the oil pan 3 and pumps it into the annular chamber 28 of filter 6. About 60% of the oil supplied flows directly into the tubule 38 and because of the small diameter of tubule 38, it is splashed at relatively high speed against the viewing glass 39 and from there, it falls as spary oil onto the machine parts inside of the housing 1 and lubricates bearing points under low stress easily accessible to the spray oil.

The other part of the oil which is conveyed into the annular chamber 28 flows under pressure through the filter material 20 into the interior 27 of the filter insert 18. The filter material 20 retains dirt particles of the oil, so that only purified or filtered oil can collect in the interior 27. The filter oil then flows through the outlet opening 16 into pipe 13, then into the blind bore 11, then into the bores 30 and 32 and finally up to the bearing surface of the bearing bracket 34 via the other bores 50 and 52. There the oil enters from bore 32 through a bore 54 of the main shaft 33 of the machine into a longitudinal bore 52 provided therein, and flows through various oblique and transverse bores onto the bearing surfaces of the crank pins 35 driving the machine parts (not shown), whereby, these highly stressed bearing points, which are not easily accessible to lubrication from the outside, are intensively supplied with filtered oil.

To change or clean the filter insert 18, the housing cover 2 is first lifted off. As soon as the filter insert 18 is raised a little, the oil return bore 29 is cleared, whereupon, the oil contained in filter housing 8 can flow back into oil pan 3 through the oil return bore 29. After filter insert 18 has been lifted, the unfiltered oil can indeed become mixed with the filtered oil inside of the filter housing 8 and thus unfiltered oil can flow toward the outlet opening 16. Before unfiltered oil can reach the outlet opening 16, even if the filter insert 18 is pulled out rapidly, enough oil has drained through the oil return bore 29 for the oil level to sink below the outlet opening 16. It is thus assured that no dirt particles of the unfiltered oil can penetrate into the outlet opening 16.

After a relatively short time, the entire oil has run out of the filter housing 8 so that when inserting the new or cleaned filter insert 18 into the empty and optionally additionally cleaned filter housing 8, no dirt particles gent into the interior 27 of the filter insert 18.

While a specific embodiment of the invention has been shown and described in detail to illustrate the application of the principles of the invention, it will be understood that the invention may be embodied otherwise without departing from such principles.

What is claimed is:

1. A sewing machine with a forced lubrication system, comprising an oil pan, a filter arranged above said oil pan, said filter having a housing, a removable filter insertable in said housing, said filter housing having an oil return bore defined therein in a position so that it is closed by insertion of said filter insert into said housing into an operative position therein, said oil return bore being cleared and opened when said filter insert is not in an operative position.

2. A sewing machine, according to claim 1, wherein said filter insert is extractable upwardly and including means in said housing defining a filter outlet above the bottom of said filter insert at a location higher than said oil return bore.

3. A sewing machine, according to claim 2, wherein said filter insert comprises a tubular filter insert having an exterior filter wall defining a filter path therethrough to the interior of said filter insert and including an outlet pipe disposed with the interior of said filter insert having an outlet opening at the upper end thereof, said filter housing having a drain opening therein below the bottom of said outlet pipe, the opening of said outlet pipe being at a location substantially equal to the height of said filter insert.

4. A sewing machine, according to claim 1, wherein said filter includes a cylindrical housing, said filter insert comprising a cylindrical member arranged in said housing spaced from the interior wall thereof, pump means for pumping oil upwardly into said housing in the space surrounding said filter, said filter insert having an exterior wall defining a passage for the flow of oil therethrough to the interior of said filter insert, said housing having an oil discharge pipe extending upwardly in said filter and having an opening for the lubricating oil, and having a lower end connected to a means for circulating the oil to the bearings of the sewing machine.

5. A force flow lubricating system for a sewing machine having a rotatable shaft supported in a sewing machine housing on bearings which require lubrication, comprising an oil pan reservoir in the sewing machine housing, a filter housing supported in the sewing machine housing above the oil pan reservoir and having an interior filter housing wall and a closable top opening, a tubular filter insert insertable into the top opening of the filter housing and being positionable in the filter housing in an operative position therein and having a peripheral wall of a filter material through which the oil is passable into the interior of said filter insert, said wall of filtering material being spaced inwardly from said interior filter housing wall, oil passage means in said filter housing extending into the interior of said filter insert and extending out of said housing to the bearings for supplying lubricating oil thereto, an oil drain passage defined in said filter housing having an inlet opening closed by said filter element when it is in an operative position and extending through said filter housing to define a drain passage overlying said oil pan reservoir, said oil drain passage opening being openable by removal of said filter insert from its operative position, and pumping means for pumping oil from said oil pan reservoir to the interior of said filter housing in the space between said filter element and said interior filter housing wall.

6. A force flow lubricating system, according to claim 5, wherein said pump means includes a pipe extending from said oil pan reservoir into said filter housing upwardly above the bottom of the filter housing, and including a tubule connected into the top of said filter housing above the opening of said pipe in a position to receive a portion of the oil circulated therefrom and to direct it in a constant stream into the sewing machine housing above the parts requiring lubrication therein.

7. A force flow lubricating system, according to claim 5, wherein said oil passage means includes a conduit extending upwardly from the interior of said filter housing into the filter insert substantially to the top of said filter insert.

8. A force flow lubricating system, according to claim 7, wherein said oil passage means includes a connection from the pipe extending into the interior of said filter insert outwardly from said filter housing to the interior of the housing of the sewing machine to the bearings requiring lubrication therein.

* * * * *